US008488814B2

(12) United States Patent
Robuchon et al.

(10) Patent No.: US 8,488,814 B2
(45) Date of Patent: Jul. 16, 2013

(54) ACOUSTIC HEADSET

(75) Inventors: Patrick Robuchon, Argenteuil (FR); Jean-François Cavelier, Paris (FR); Monique Mitte, Montigny-les-Cormeilles (FR)

(73) Assignee: Elno Societe Nouvelle, Argenteuil (FR)

( * ) Notice: Subject to any disclaimer, the term of this patent is extended or adjusted under 35 U.S.C. 154(b) by 105 days.

(21) Appl. No.: 12/682,166

(22) PCT Filed: Oct. 9, 2008

(86) PCT No.: PCT/FR2008/051833

§ 371 (c)(1), (2), (4) Date: Nov. 12, 2010

(87) PCT Pub. No.: WO2009/053623

PCT Pub. Date: Apr. 30, 2009

(65) Prior Publication Data

US 2011/0051960 A1 Mar. 3, 2011

(30) Foreign Application Priority Data

Oct. 9, 2007 (FR) ..... 07 58170

(51) Int. Cl.
*H04R 25/00* (2006.01)

(52) U.S. Cl.
USPC ..... 381/151; 381/378; 381/380

(58) Field of Classification Search
USPC ..... 381/326, 151, 370–372, 375–380
See application file for complete search history.

(56) References Cited

U.S. PATENT DOCUMENTS

| | | | |
|---|---|---|---|
| 5,404,577 | A | 4/1995 | Zuckerman et al. |
| 6,456,721 | B1 | 9/2002 | Fukuda |

FOREIGN PATENT DOCUMENTS

| | | | |
|---|---|---|---|
| EP | 1 130 880 | A1 | 9/2001 |
| JP | 56-169685 | S | 12/1981 |
| WO | 2007/069784 | A1 | 6/2007 |

*Primary Examiner* — Suhan Ni
(74) *Attorney, Agent, or Firm* — Sughrue Mion, PLLC

(57) ABSTRACT

This acoustic headset (2) comprises:
- two lateral acoustic modules (4, 6) comprising a mechanical bone excitation transducer (20, 22) which is capable of transmitting the sound signal to the auditory nerve by bone conduction,
- a flexible upper curved member (8) and a rigid rear curved member (10) for connecting the acoustic modules (4, 6).

Figure 1:
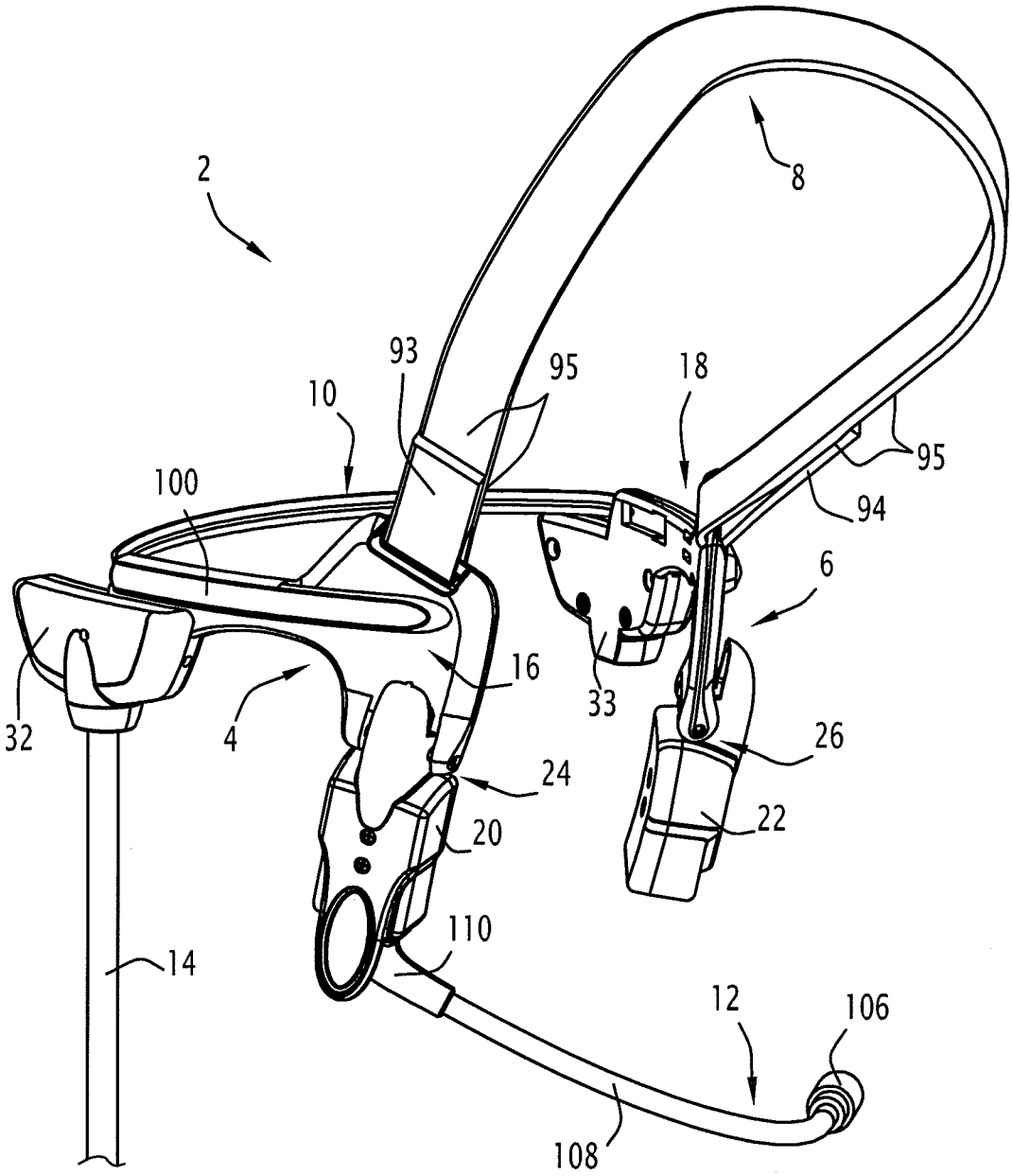

Each acoustic module (4, 6) comprises:
- a plate (16, 18) for lateral abutment against the sides of the skull,
- an articulation (24, 26) between the abutment plate (16, 18) and the transducer (20, 22),
- a spring for return movement, in terms of rotation about the axis of articulation (24, 26), of the transducer (20, 22) relative to the plate (16, 18) towards a rest position.

10 Claims, 4 Drawing Sheets

ACOUSTIC HEADSET

The present invention relates to an acoustic headset comprising:

two lateral acoustic modules comprising a mechanical bone excitation transducer which is capable of transmitting the sound signal to the auditory nerve by bone conduction, at least one curved member for connecting the acoustic modules.

The invention also relates to a piece of head gear for infantrymen comprising a heavy helmet and an acoustic headset of this type.

An acoustic headset of the prior art comprises two lateral acoustic modules and a curved member for connecting the two acoustic modules. Each lateral acoustic module comprises a mechanical bone excitation transducer which is capable of converting an electrical signal into a vibrating wave which represents the sound signal and of transmitting the sound signal to the auditory nerve by means of bone conduction.

In order best to transmit the sound signal by bone conduction, the transducer must have the majority of the internal surface thereof in contact with a corresponding lateral side of the skull of the user, in particular with the temporal bone of the skull.

When the user positions the headset on his head, he begins by positioning the curved member for connecting the acoustic modules, then he adjusts the position of each module.

However, taking into consideration the shape of the human skull and the fact that the transducer is fixed in position in the module, only a small portion of the internal surface of the transducer is often in contact with the temporal bone, bringing about impairment of the auditory portion of the headset.

An ergonomic shape of the acoustic module does not allow that problem to be solved because each human skull has a specific shape.

Therefore, an object of the invention is to allow provision of a large contact surface-area between the transducers and the temporal bones of the skull in order to achieve good auditory quality and comfortable wearing of the headset.

Thus, the invention relates to an acoustic headset as described above, characterised in that each acoustic module comprises:

a plate for lateral abutment against the sides of the skull, an articulation between the abutment plate and the transducer, a spring for return movement, in terms of rotation about the axis of articulation, of the transducer relative to the plate towards a rest position.

According to other embodiments, the acoustic headset comprises one or more of the following features taken in isolation or in accordance with any technically possible combination:

the maximum angle of rotation of the articulation about the axis thereof is a minimum of 60°, the return movement applied by each spring of a module is directed from that module towards the other module, the transducer has at least one additional degree of freedom in terms of rotation about an axis which is angularly displaced from the axis of articulation, the articulation comprises an articulation shaft which connects the transducer to the plate, and the component among the plate and the transducer which is capable of rotating about the shaft for articulation comprises through-holes for the shaft, the holes having a diameter greater than the diameter of the shaft, the acoustic headset comprises an upper curved member which is for connecting the acoustic modules and which is capable of moving into abutment against the upper portion of the head and a rear curved member which is for connecting the acoustic modules and which is capable of moving into abutment against the rear of the head, each curved member has an adjustable length, the acoustic headset comprises an electroacoustic microphone which is connected to an acoustic module, in particular to the transducer of the acoustic module, the acoustic headset is capable, owing to its dimensions, of being used with a heavy helmet for infantrymen or with a nuclear bacteriological chemical mask.

The invention also relates to a piece of head gear for infantrymen comprising a heavy helmet and an acoustic headset of this type.

Figure 2:
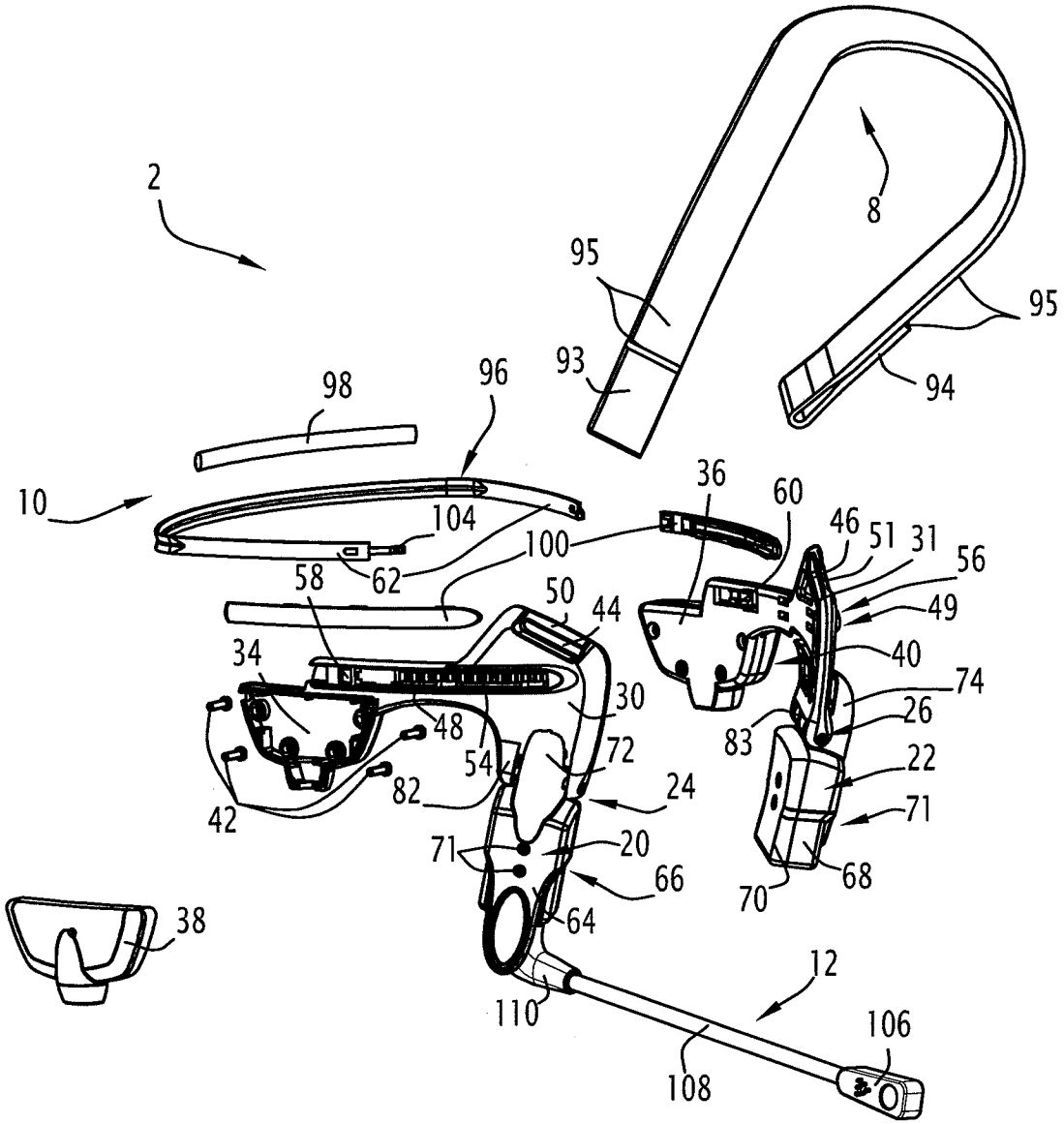
Figure 3:
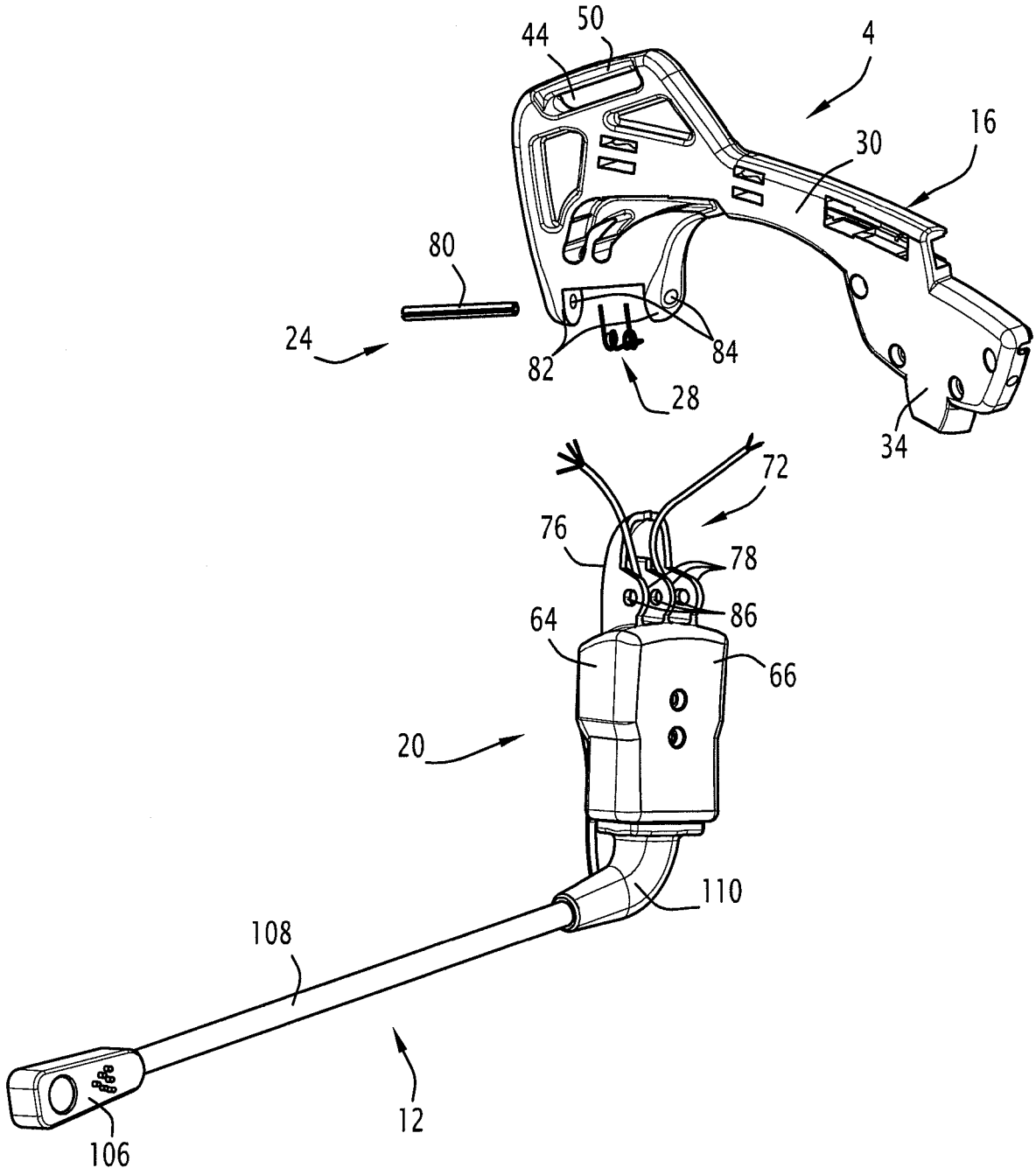
Figure 4:
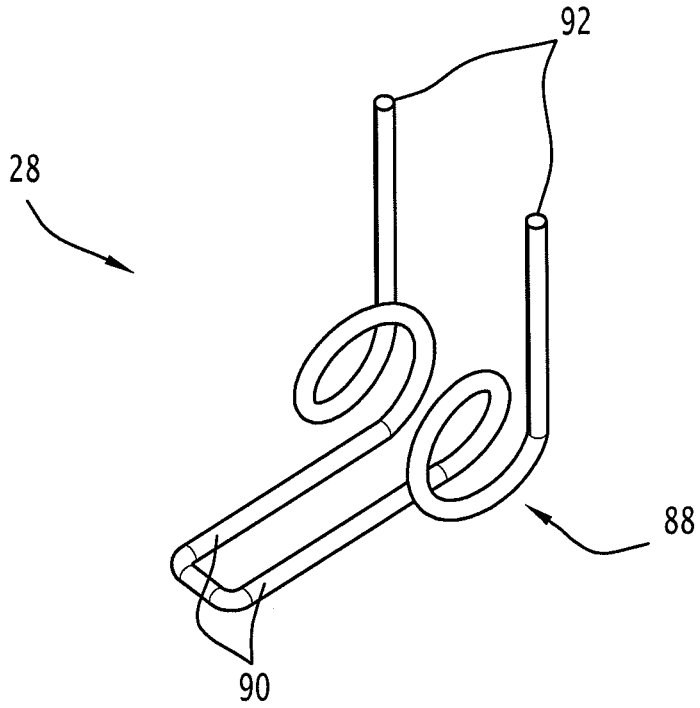

The invention and its advantages will be better understood from a reading of the following description which is given purely by way of example and with reference to the appended drawings, in which:

FIG. 1 is a general perspective view of the acoustic headset according to the invention, FIG. 2 is an exploded perspective view of the acoustic headset according to the invention, FIG. 3 is an exploded perspective view of an acoustic module for the right ear according to the invention and FIG. 4 is a perspective view of a return spring according to the invention.

In FIG. 1, an acoustic headset 2 comprises two lateral acoustic modules 4, 6, an upper curved member 8 and a rear curved member 10 for connecting the acoustic modules 4, 6. The headset 2 further comprises a microphone 12 which is connected to the acoustic module 4 and a headset wire 14.

Each acoustic module 4, 6 comprises a plate 16, 18 for lateral abutment against the sides of the skull and a mechanical bone excitation transducer 20, 22. An articulation 24, 26 is provided between the abutment plate 16, 18 and the transducer 20, 22. A spring 28, which is visible in FIGS. 3 and 4, is provided for each articulation and is capable of ensuring return movement, in terms of rotation about the axis of articulation 24, 26, of the transducer 20, 22 relative to the plate 16, 18 towards a rest position.

Each plate 16, 18 of FIGS. 1 and 2 comprises an abutment plate 30, 31 which is capable of moving into abutment against the skull above an ear. A through-opening for the ear is provided in the lower portion of each plate 30, 31. Each plate 16, 18 comprises, in the rear portion of the plate 30, 31, a housing 32, 33 which comprises a first half-shell 34, 36 and a second half-shell 38, 40 which is fixed to the first half-shell 34, 36 via fixing means 42, such as screws 42 having countersunk heads.

The first half-shell 34, 36 and the second half-shell 38, 40 together delimit a trapezoidal caisson-like structure which has a closed cross-section and which is capable of receiving in particular the wire 14 of the headset.

The abutment plate 30, 31 comprises an oblong opening 44, 46 which receives an end of the upper curved member 8. The rear curved member 10 comprises a guiding conduit 48, 49 which is provided in the abutment plate 30, 31 and which has an elongate shape in the main direction of the abutment plate 30, 31.

The oblong opening 44, 46 is particularly near an upper edge of the abutment plate 30, 31, the material remaining between the opening 44, 46 and the upper edge forming a rod 50, 51.

Each guiding conduit 48, 49 comprises, in its recess, at one end and over a portion of the length thereof, a rack 54, 56 which comprises reliefs which are spaced apart in such a manner that the longitudinal section of the rack 54, 56 is of saw-tooth-like shape and, at the other end, a through-hole 58, 60 for a rod 62 of the rear curved member 10.

The main abutment plate 30, 31 and the half-shells 34, 36, 38, 40 of the housings 32, 33 are, for example, of plastics material and injection-moulded.

Each mechanical bone excitation transducer 20, 22 is capable of converting an electrical signal into a vibrating wave which represents the sound signal and of transmitting the sound signal to the auditory nerve by bone conduction. The transducer 20, 22 comprises an element (not illustrated) which is capable of transmitting vibrating waves from the electrical signals received and two half-shells 64, 66, 68, 70 which protect the transmitting element which is not illustrated.

The half-shells 64 and 66, 68 and 70 are connected, for example, via fixing means 71, such as screws 71 having countersunk heads. The half-shells 64, 66, 68, 70 are, for example, of plastics material and injection-moulded.

The half-shells 64 and 68 which are located at the outer sides of the headset 2 each comprise an integral lug 72, 74 for connection to the plate 16, 18. The lugs 72, 74 have a U-like cross-section which is open towards the inner side of the headset and comprise a web 76 and at least two flanges 78 which extend towards the inner side of the headset from the web 76 and perpendicularly relative thereto. Each lug 72, 74 has, for example, three flanges 78.

In FIGS. 2 and 3, the articulation 24, 26 comprises an articulation shaft 80 which connects the transducer 20, 22 to the abutment plate 16, 18. The plate 16, 18 has a cover 82, 83, in which there is received the lug 72, 74, through-holes 84 for the articulation shaft 80 being provided in the cover 82, 83. The flanges 78 of the lug 72, 74 of the transducer 20, 22 have through-holes 86 for the shaft 80.

The transducer 20, 22 is capable of moving in rotation relative to the plate 16, 18 between two extreme positions. The first position of the transducer 20, 22 which is also referred to as the rest position corresponds to a position perpendicular to the plate 16, 18 towards the inner side of the headset 2. The second position of the transducer 20, 22 corresponds to a position which is substantially in continuation of the plate 16, 18.

The maximum angle of rotation of the articulation 24, 26 about its axis is a minimum of 60° and is particularly 90°.

The transducer 20, 22 is capable of rotating about the articulation shaft 80. The through-holes 86 have a diameter greater than the diameter of the shaft 80 so that the transducer 20, 22 has at least one additional degree of freedom in terms of rotation about an axis which is angularly displaced, for example, by 5°, from the axis of articulation 24, 26.

The return spring 28 of FIG. 4 comprises a central helical winding 88 and ends 90, 92 which extend in two directions and which are perpendicular to each other when the spring is in a rest position.

The ends 90 of the spring 28 are fixed to the transducer 20, 22 and the ends 92 which are fixed to the abutment plate 16, 18, the articulation shaft 80 extending inside the winding 88, so that the return movement applied by the spring 28, when the spring 28 is not in a rest position, is directed from one module 4, 6 towards the other module 4, 6.

The spring 28 is, for example, constructed by a metal rod being deformed.

The upper curved member 8, which is also referred to as the head-band 8, has an adjustable length and is capable of being positioned on the upper portion of the head.

The upper curved member 8 is thin and is constructed from a flexible material. The thickness of the upper curved member 8 is, for example, less than 2 mm.

The upper curved member 8 is, for example, a band 8 whose ends 93, 94 are folded over and fixed to the body of the band 8 via fixing means 95, such as complementary connection strips 95 having hooks and loops.

The end 93 engages, at the inner side of the acoustic module 4, in the oblong opening 44 and extends at the outer side of the module 4 in order to be fixed to the body of the band 8 via the means 95 so that the band 8 forms a retention loop around the rod 50, thereby connecting the upper curved member 8 to the module 4.

The other end 94 of the band 8 extends through the hole 46 of the acoustic module 6 in order to be fixed to the body of the band 8 via the means 95 and to form a retention loop around the rod 51, thereby connecting the upper curved member 8 to the module 6.

The rear curved member 10, which is constructed from a rigid material, is a curved member for mechanically retaining the two modules 4, 6.

The rear curved member 10 comprises, for example, a main body 96 which is of elongate and curved shape and whose ends are constituted by the rods 62. A comfort foam 98 surrounds the main body 96. The rear curved member 10 comprises the guiding conduits 48, 49 and covers 100 for protecting the rod 62 and the ends 104 of the rod 62, the covers covering the conduits 48, 49.

The main body 96 and the rod 62 are, for example, metal plates which have a width of less than 1 cm and a thickness of less than 2 mm.

The rear curved member 10 has an adjustable length owing to the rod 62 sliding in the guiding conduits 48, 49. The rear curved member 10 which is also referred to as the nape-band 10, is capable of being positioned under the otic bone behind the head, near the nape of the neck.

Each end 104 of the rod 62 is curved in accordance with a V shape and engages in the holes 58, 60, then slides in the guiding conduits 48, 49, before becoming engaged in the reliefs of the rack 54, 56. The lateral fixing of the rod 62 is brought about by the edges of the holes 58, 60 and the longitudinal fixing of the rod 62 is brought about by the engagement of the V-like ends 104 in the reliefs of the rack 54, 56.

The electroacoustic microphone 12 comprises an analogue sensor 106 which is for sensing the acoustic sound waves and which is connected to a hollow and deformable rod 108 which receives the electric cables at the centre thereof and which is capable of being curved in different directions, and a hollow elbow piece 110 for fixing the rod 108 to the acoustic module 4.

In this manner, a user of the headset 2 begins by approximately adjusting the length of the head-band 8 using the fixing means 94, then the length of the nape-band 10, by sliding the rod 62 in the guiding conduits 48, 49 in one direction or the other.

Subsequently, the user moves the transducer 20, 22 away from the plate 16, 18 from the rest position, by means of rotation about the articulation 24, 26, and the sensor 106 of the microphone 12 if the rod 108 were to be folded towards the inner side of the headset 2.

The user positions the headset 2 on his head by positioning the band 8 on the upper portion of his skull, the rear curved member 10 behind his head near his nape and the plates 16, 18 for lateral abutment against the sides of his skull, the plate 16 above the right ear and the plate 18 above the left ear. The opening provided in the lower portion of the abutment plates 30, 31 brings about good ergonomy of the plate 16, 18 in relation to the upper portion of the external ear.

After positioning the headset 2 on his head, the user adjusts the upper curved member 8 on his head, then the rear curved member 10 on his nape, by adjusting the length of the curved member 8 using the fixing means 95 and the length of the curved member 10 by sliding the rod 62 in the guiding conduits 48, 49.

Once the length of the curved members 8, 10 is adjusted, the articulations 24, 26 and the spring 28 allow the transducers 20, 22 to be kept in contact with the right and left temporal bones of the skull. The adjustment of the position of the mechanical bone excitation transducers 20, 22 on the temples is carried out naturally and automatically owing to the additional degree of freedom in terms of rotation about the axis which is angularly displaced from the axis of articulation 24, 26.

The adjustment of the transducers 20, 22 which is carried out in this manner allows a good level of reception to be obtained and the headset 2 to be worn comfortably.

Finally, the user adjusts the position of the sensor 106 of the microphone 12 in relation to his mouth by bending the rod 108.

After removal, the headset 2 can be readily put away because the transducers 20, 22 are automatically moved, under the action of the spring, towards the interior and into the plane of the headset.

The upper curved member 8 allows, owing to its small thickness and its flexible material, a heavy helmet to be worn without discomfort on top of the head. The rear curved member 10, since it is positioned under the otic bone behind the head, also allows all heavy combat helmets to be worn.

The mechanical fixing of the two modules 4, 6 is brought about by the rear curved member 10 whilst the upper curved member 8 serves to fix the arrangement in position on top of the head.

According to another embodiment, the abutment plate 16, 18 is capable of rotating about the articulation shaft 80 and the through-holes 84 have a diameter greater than the diameter of the shaft 80.

According to other embodiments, the headset 2 is capable of being used with motorcyclists' helmets, crash helmets for motor vehicle drivers, headsets for armored vehicles, firemen's helmets, helmets for agents of the security services, helmets for building sites, aircraft pilots' helmets.

According to other embodiments, the headset 2 is a headset for switchboard operators.

The invention claimed is:

1. Acoustic headset (2) comprising:

two lateral acoustic modules (4, 6) comprising a mechanical bone excitation transducer (20, 22) which is capable of transmitting the sound signal to the auditory nerve by bone conduction, at least one curved member (8, 10) for connecting the acoustic modules (4, 6), characterised in that each acoustic module (4, 6) comprises:

a plate (16, 18) for lateral abutment against the sides of the skull, an articulation (24, 26) between the abutment plate (16, 18) and the transducer (20, 22), a spring (28) for return movement, in terms of rotation about the axis of articulation (24, 26), of the transducer (20, 22) relative to the plate (16, 18) towards a rest position.

2. Acoustic headset (2) according to claim 1, characterised in that the maximum angle of rotation of the articulation (24, 26) about the axis thereof is a minimum of 60°.

3. Acoustic headset (2) according to claim 1, characterised in that the return movement applied by each spring (28) of a module (4, 6) is directed from the module (4, 6) towards the other module (4, 6).

4. Acoustic headset (2) according to claim 1, characterised in that the transducer (20, 22) has at least one additional degree of freedom in terms of rotation about an axis which is angularly displaced from the axis of articulation (24, 26).

5. Acoustic headset (2) according to claim 4, characterised in that the articulation (24, 26) comprises a shaft (80) for articulation (24, 26) which connects the transducer (20, 22) to the plate (16, 18), and in that the component among the plate (16, 18) and the transducer (20, 22) which is capable of rotating about the shaft (80) for articulation (24, 26) comprises through-holes (86) for the shaft (80), the holes (86) having a diameter greater than the diameter of the shaft (80).

6. Acoustic headset (2) according to claim 1, characterised in that it comprises an upper curved member (8) which is for connecting the acoustic modules (4, 6) and which is capable of moving into abutment against the upper portion of the head and a rear curved member (10) which is for connecting the acoustic modules (4, 6) and which is capable of moving into abutment against the rear of the head.

7. Acoustic headset (2) according to claim 1, characterised in that the or each curved member (8, 10) has an adjustable length.

8. Acoustic headset (2) according to claim 1, characterised in that it comprises an electroacoustic microphone (12) which is connected to an acoustic module (4, 6), in particular to the transducer (20, 22) of the acoustic module (4, 6).

9. Acoustic headset (2) according to claim 1, characterised in that it is, owing to its dimensions, capable of being used with a heavy helmet for infantrymen or with a nuclear bacteriological chemical mask.

10. Piece of head gear for infantrymen comprising a heavy helmet and an acoustic headset (2) of the type according to claim 1.

* * * * *